US008387537B2

(12) United States Patent
Brus et al.

(10) Patent No.: US 8,387,537 B2
(45) Date of Patent: Mar. 5, 2013

(54) CONSUMABLE CARTRIDGE FOR MUZZLE LOADING FIREARMS

(75) Inventors: Giovanni Brus, Longwood, FL (US); William Lee Hearn, Miami, FL (US); Greg Dixon, Sebring, FL (US)

(73) Assignee: Thundercharge Corp., Longwood, FL (US)

( * ) Notice: Subject to any disclaimer, the term of this patent is extended or adjusted under 35 U.S.C. 154(b) by 1425 days.

(21) Appl. No.: 11/341,896

(22) Filed: Jan. 30, 2006

(65) Prior Publication Data

US 2006/0169164 A1 Aug. 3, 2006

Related U.S. Application Data

(60) Provisional application No. 60/647,429, filed on Jan. 28, 2005.

(51) Int. Cl.
*F42B 5/18* (2006.01)
*F42B 5/192* (2006.01)

(52) U.S. Cl. ..... 102/431; 102/464

(58) Field of Classification Search ..... 102/431, 102/432, 433, 464

See application file for complete search history.

(56) References Cited

U.S. PATENT DOCUMENTS

| | | | | | |
|---|---|---|---|---|---|
| 1,411 | A * | 11/1839 | Crum | ..... | 470/64 |
| 35,699 | A * | 6/1862 | Mayberry | ..... | 102/432 |
| 3,098,444 | A * | 7/1963 | Walkey et al. | ..... | 102/464 |
| 3,348,445 | A * | 10/1967 | Nadel | ..... | 86/1.1 |
| 3,987,731 | A * | 10/1976 | Brzuskiewicz | ..... | 102/464 |
| 4,709,636 | A * | 12/1987 | Mueller et al. | ..... | 102/431 |
| 5,323,707 | A * | 6/1994 | Norton et al. | ..... | 102/431 |
| 5,449,423 | A | 9/1995 | Cioffe | | |
| 5,557,151 | A | 9/1996 | Epstein et al. | | |
| 5,633,476 | A | 5/1997 | Cioffe | | |
| 5,726,378 | A | 3/1998 | Barrett | | |
| 6,334,394 | B1 * | 1/2002 | Zimmermann et al. | ..... | 102/286 |
| 6,688,232 | B2 | 2/2004 | Griesbach et al. | | |
| 6,877,415 | B2 | 4/2005 | Griesbach et al. | | |
| 2004/0144457 | A1 | 7/2004 | Barrett et al. | | |
| 2006/0011086 | A1 * | 1/2006 | Rose et al. | ..... | 102/364 |

OTHER PUBLICATIONS

Goodpaster, John V. et al., "Identification of Ascorbic Acid and Its Degradation Products in Black Powder Substitutes", J Forensic Sci, May 2004, vol. 49, No. 3, pp. 523-528.

* cited by examiner

*Primary Examiner* — David Parsley
(74) *Attorney, Agent, or Firm* — Welsh Flaxman & Gitler LLC

(57) ABSTRACT

A consumable cartridge for a muzzle loading firearm having a consumable cartridge case composed of a consumable solid material is set forth. The cartridge case including a central internal cavity, the cartridge case having a closed first end and a second end open to the central internal cavity for receipt of granular, explosive powder within the central internal cavity of the cartridge case and a bullet is secured to the closed first end of the cartridge case. The cartridge case is shaped and dimensioned for positioning within a bore of a rifle along with the bullet.

20 Claims, 1 Drawing Sheet

CONSUMABLE CARTRIDGE FOR MUZZLE LOADING FIREARMS

CROSS REFERENCE TO RELATED APPLICATIONS

This application is based upon and claims the benefit of U.S. Provisional Application Ser. No. 60/647,429, filed Jan. 28, 2005, entitled "CONSUMABLE CASELESS CARTRIDGE FOR MUZZLE LOADING FIREARMS".

BACKGROUND OF THE INVENTION

Field of the Invention

The invention relates to cartridges for firearms. More particularly, the invention relates to consumable cartridges for muzzle loading firearms.

SUMMARY OF THE INVENTION

It is, therefore, an object of the present invention to provide a consumable cartridge for a muzzle loading firearm having a consumable cartridge case composed of a consumable solid material. The cartridge case includes a central internal cavity. The cartridge case has a closed first end and a second end open to the central internal cavity for receipt of granular, explosive powder within the central internal cavity. A paper disk covers the second end of the cartridge case to maintain the explosive powder within the central internal cavity of the cartridge case and a bullet is secured to the closed first end of the cartridge case. The cartridge case is shaped and dimensioned for positioning within a bore of a rifle along with the bullet.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
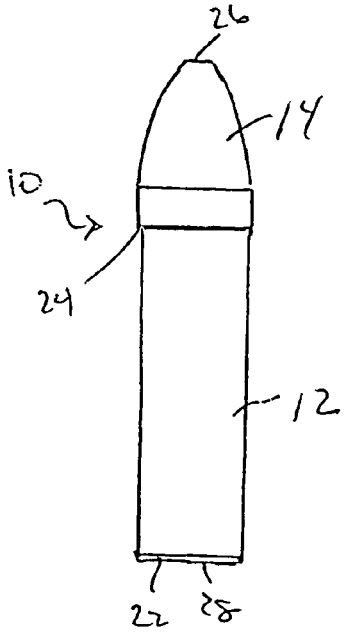
FIG. 1 is a side view of the consumable cartridge of the present invention attached to a bullet.
Figure 2:
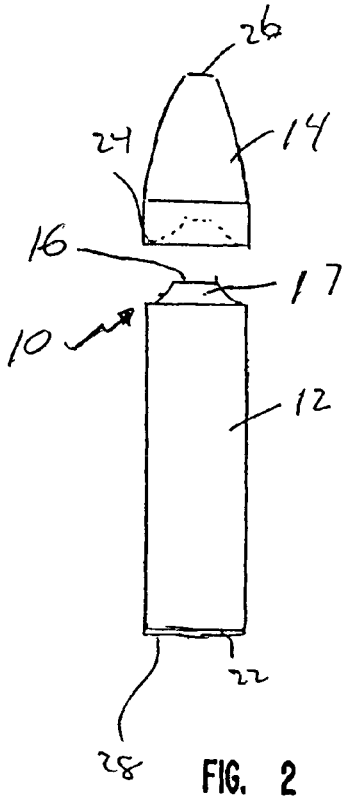
FIG. 2 is a side view of the consumable cartridge of the present invention separated from a bullet.
Figure 3:
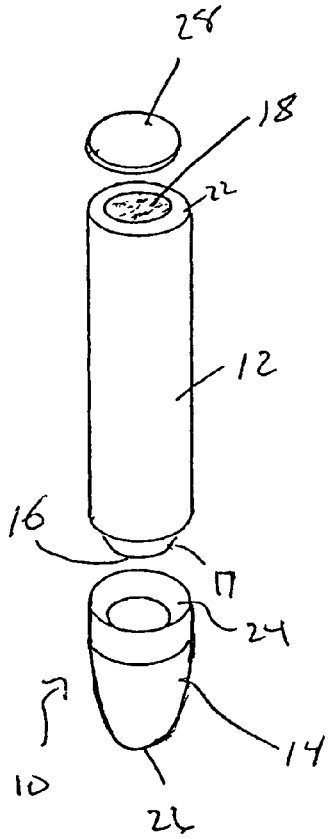
FIG. 3 is an exploded perspective view of the consumable cartridge of the present invention.
Figure 4:
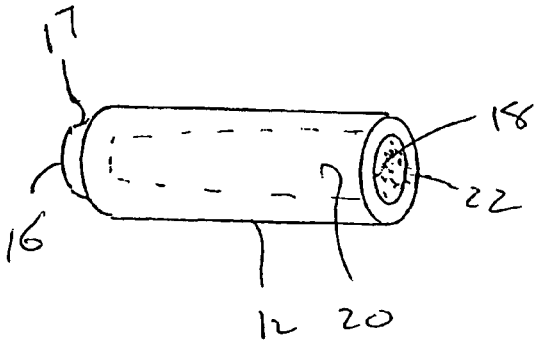
FIG. 4 is a side perspective view of the consumable cartridge of the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

With reference to the various figures, a consumable cartridge 10 for a muzzleloader firearm is disclosed. The cartridge 10 includes a consumable cartridge case 12 and a bullet

14 that is secured to the first end 16 of the cartridge case 12 in a manner described below in greater detail. The present consumable cartridge 10 provides for the convenient firing of a muzzleloader rifle without the conventional requirement of loading powder and bullets in separate steps. In practice, the cartridge case 12, with the explosive powder 18 therein, is ignited propelling the bullet 14 from the rifle bore as the cartridge case 12 is fully consumed by the heat generated during the explosion of the powder 18. The explosive powder 18 may be the same or similar to that disclosed in U.S. Pat. Nos. 5,449,423 and 5,633,476 to Cioffe, which are incorporated herein by reference. As those skilled in the art will certainly appreciate, the term consumable as used herein indicates that the cartridge is fully destroyed as a result of the ignition of the explosive powdering during firing of a bullet.

The cartridge case 12 is shaped and dimensioned for positioning within the bore of a muzzleloader rifle. In particular, and in accordance with a preferred embodiment of the present invention, the outside diameter of the cartridge case 12 is approximately 0.001 inches to approximately 0.020 inches less then the bore diameter of the rifle. With this in mind, the cartridge case 12, as well as the bullet 14, may be manufactured in various calibers without departing from the spirit of the present invention.

Figure 5:
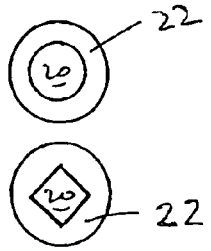
FIG. 5 shows an end view of two different embodiments of the consumable cartridge of the present invention showing the internal profile of the central internal cavity.

The cartridge case 12 is generally cylindrical and includes a central internal cavity 20 shaped and dimensioned for receiving explosive powder 18. As will be appreciated by those skilled in the art, the cavity shape employed in conjunction with the cartridge case 12 may take a variety of forms depending upon the desired charge characteristics. For example and as shown in FIG. 5, the cavity 20 may be round or square, but other shapes such as hexagonal, etc, are within the spirit of the present invention. In accordance with a preferred embodiment of the present invention, the cartridge case 12 has a wall thickness of approximately 0.025 inches to approximately 0.125 inches.

The cartridge case 12 includes a first end 16 and a second end 22. The performance of the present cartridge 12 is enhanced by forming the central internal cavity 20 with a slight taper as it extends from the second end 22 of the cartridge case 12 to the first end 16 of the cartridge case 12 such that central internal cavity 20 adjacent the first end 16 is narrower than the central internal cavity 20 adjacent the second end 22. In accordance with a preferred embodiment of the present invention, the taper is approximately 0.01 degrees to approximately 5.0 degrees.

The first end 16 is closed and is shaped and dimensioned for receiving the rearward end 24 of the bullet 14. In accordance with a preferred embodiment of the present invention, the first end 16 is formed with a substantially frusto-conical shape, wherein the walls of the cone exhibit a slight concavity. The first end 16 is shaped and dimensioned to provide a friction fit with the rearward end 24 of the bullet 14 when the bullet 14 is secured thereto.

With this in mind, the bullet 14 is formed in a conventional manner with a pointed forward end 26 and a concave rearward end 24. The concave rearward end 24 is shaped and dimensioned for receiving the frusto-conical projection 17 at the first end 16 of the cartridge case 12. More particularly, the rearward end 24 of the bullet 14 and the first end 16 of the cartridge case 12 are dimensioned to frictionally engage each other in a manner securely holding the bullet 14 atop the cartridge case 12.

While a frictional engagement structure is disclosed in accordance with a preferred embodiment of the present invention, other coupling techniques, for example, adhesive, may be used in conjunction with or as a replacement for the frictional engagement structure disclosed above. In addition, the present cartridge is contemplated for sale and use with the bullet secured to the cartridge case prior to placement within the rifle bore. However, those skilled in the art will appreciate that the cartridge case and bullet may remain separate and be loaded within the rifle bore sequentially prior to use.

The second end 22 of the cartridge case 12 is open providing ready access to the central internal cavity 20 for receiving the granular, explosive powder 18 used as a propellant in accordance with the present invention. Once the central internal cavity 20 of the cartridge case 12 is filled with granular, explosive powder 18, the second end 22 is covered with a paper disk 28. The paper disk 28 assists in maintaining the explosive powder within the cartridge case 12 and igniting the granular explosive powder 18. In accordance with a preferred embodiment of the present invention, the paper disk 28 is composed of nitrocellulose paper, flash paper or nitrated paper. The paper disk 28 is secured to the second end 22 via nitrocellulose glue or other adhesive.

The cartridge case 12 is consumable and is composed of a mixture of nitrate salt, perchlorate salt and an organic fuel. The cartridge case 12 may also optionally include binders and other additives determined to improve manufacturing and performance. More particularly, and in accordance with a preferred embodiment, the cartridge case 12 is composed of potassium nitrate (approximately 20% to approximately 60% by weight), potassium perchlorate (approximately 0.5% to approximately 25% by weight, and, more preferably, approximately 15% to approximately 25% by weight) and organic fuel (approximately 25% to approximately 45% by weight).

The organic fuel is chosen from the group consisting of polyhydroxy-hydrocarbons (sugar alcohols), polyhydroxy-carboxylic acids (sugar acids) and salts thereof. More particularly, the fuel is ascorbic acid, erythorbic acid or other isomers of ascorbic acid or salt, ester or ether thereof.

As mentioned above, the cartridge case 12 may include binders. In accordance with a preferred embodiment, the binder is nitrated cellulose or other organic polymers. The binder is applied to the mixture in a quantity of approximately 0.5% to approximately 10% by weight.

The mixture may also include additives assisting in the performance of the cartridge case 12. Included among these additives are carbon and graphite, which may function as a lubricant. The mixture may also be supplemented with the inclusion of plasticizers and combustion modifiers.

The cartridge case 12 is preferably formed by compressing the mixture described above in a mold under pressure from approximately 1,000 psi to 20,000 psi. As mentioned above, the cartridge case 12 is filled with an explosive powder 18. In accordance with a preferred embodiment of the present invention, the powder 18 may also be the same as the mixture described above for use in the manufacture of the cartridge case 12. However, the mixture for use as the explosive powder 18 is merely granulated to a fine powder and then compressed within the cartridge case to a density of approximately 1.5 to approximately 1.9 grams/cubic cm.

EXAMPLES OF APPLICATIONS OF THE PRESENT INVENTION

Example 1

A caseless cartridge of 100 grains weight, manufactured as described herein, was attached to a 50 caliber 348 grain Powerbelt™ and fired in a Knight Master Hunter™ rifle with Remington #209 primer. The resulting velocity (average of five shots) was 1776 feet per second with a standard deviation of 26 feet per second.

Example 2

A caseless cartridge of 100 grains weight, manufactured as described herein, was attached to a 50 caliber plastic sabot containing a 222 grain tungsten Thunderhead™ bullet and fired in a Knight Master Hunter™ rifle with Remington #209 primer. The resulting velocity (average of five shots) was 1905 feet per second with a standard deviation of 15 feet per second.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A consumable cartridge for a muzzle loading firearm, comprising:

a consumable cartridge case including a central internal cavity, the cartridge case includes a first end and a second end open to the central internal cavity for receipt of granular, explosive powder within the central internal cavity, the cartridge case being shaped and dimensioned for positioning within a bore of a rifle;

a paper disk covering the second end of the cartridge case maintaining the explosive powder within the central internal cavity of the cartridge case;

wherein the cartridge case is composed of a consumable solid explosive material comprising nitrate salt, perchlorate salt and a fuel.

2. The cartridge according to claim 1, wherein the cartridge case is composed of potassium nitrate, potassium perchlorate and organic fuel.

3. The cartridge according to claim 2, wherein the cartridge case is composed of approximately 20% to approximately 60% by weight potassium nitrate, approximately 15% to approximately 25% by weight potassium perchlorate and approximately 25% to approximately 45% by weight organic fuel.

4. The cartridge according to claim 2, wherein the organic fuel is ascorbic acid, erythorbic acid or other isomers of ascorbic acid or salt, ester or ether thereof.

5. The cartridge according to claim 1, wherein a bullet is secured to the first end of the cartridge case.

6. The cartridge according to claim 5, wherein the first end of the cartridge case is formed with a substantially frusto-conical shape shaped and dimensioned for receiving a rearward end of the bullet.

7. The cartridge according to claim 1, wherein the cartridge case has a wall thickness of approximately 0.025 inches to approximately 0.125 inches.

8. The cartridge according to claim 1, wherein the central internal cavity includes a slight taper as it extends from the second end of the cartridge casing to the first end of the cartridge casing such that the central internal cavity adjacent first end of the cartridge case is narrower than the central internal cavity adjacent the second end of the cartridge case.

9. The cartridge according to claim 8, wherein the taper is approximately 0.01 degrees to approximately 5.0 degrees.

10. The cartridge according to claim 1, wherein the paper disk is composed of nitrocellulose paper, flash paper or nitrated paper.

11. A consumable cartridge for a muzzle loading firearm, comprising:

a hollow cartridge case composed of a mixture of nitrate salt, approximately 15% to approximately 25% by weight potassium perchlorate and an organic fuel; and wherein the hollow cartridge case is filled with a granular explosive powder.

12. The cartridge according to claim 11, wherein the nitrate salt is potassium nitrate.

13. The cartridge according to claim 12, wherein the cartridge case is composed of approximately 20% to approximately 60% by weight potassium nitrate and approximately 25% to approximately 45% by weight organic fuel.

14. The cartridge according to claim 11, wherein the organic fuel is chosen from the group consisting of polyhydroxy-hydrocarbons (sugar alcohols), polyhydroxy-carboxylic acids (sugar acids) and salts thereof.

15. The cartridge according to claim 11, wherein the organic fuel is ascorbic acid, erythorbic acid or other isomers of ascorbic acid or salt, ester or ether thereof.

16. The cartridge according to claim 11, wherein the cartridge case further includes a binder.

17. A consumable cartridge for a muzzle loading firearm, comprising:

a consumable cartridge case composed of a consumable solid explosive material comprising nitrate salt, perchlorate salt and a fuel including a central internal cavity, the cartridge case includes a first end and a second end open to the central internal cavity for receipt of granular, explosive powder within the central internal cavity, the cartridge case being shaped and dimensioned for positioning within a bore of a rifle;

a paper disk covering the second end of the cartridge case maintaining the explosive powder within the central internal cavity of the cartridge case; and wherein a bullet is secured to the first end of the cartridge case.

18. The cartridge according to claim 17, wherein the first end of the cartridge case is formed with a substantially frustoconical shape shaped and dimensioned for receiving a rearward end of the bullet.

19. The cartridge according to claim 17, wherein the cartridge case has a wall thickness of approximately 0.025 inches to approximately 0.125 inches.

20. The cartridge according to claim 17, wherein the central internal cavity includes a slight taper as it extends from the second end of the cartridge casing to the first end of the cartridge casing such that the central internal cavity adjacent first end of the cartridge case is narrower than the central internal cavity adjacent the second end of the cartridge case.

* * * * *